United States Patent [19]

Brasa

[11] 4,273,044

[45] Jun. 16, 1981

[54] SERIGRAPHIC PRINTING MACHINE PRINTING A NUMBER OF OBJECTS IN SEVERAL COLORS

[76] Inventor: Umberto Brasa, Via Ippolito Nievo, No. 8, Milan, Italy

[21] Appl. No.: 115,064

[22] Filed: Jan. 24, 1980

[30] Foreign Application Priority Data

Mar. 12, 1979 [IT] Italy ..... 20895 A/79

[51] Int. Cl.[3] ..... B41F 1/12; B41F 1/34; B41F 17/38

[52] U.S. Cl. ..... 101/193; 101/44; 101/316

[58] Field of Search ..... 101/115, 193, 200, 287, 101/297, 298, 300, 299, 301–305, 306, 307, 308, 309, 310–315, 316–321, 41–44; 271/213; 414/778, 779, 780, 781

[56] References Cited

U.S. PATENT DOCUMENTS

| | | | |
|---|---|---|---|
| 373,426 | 11/1887 | Barker | 101/193 |
| 885,709 | 4/1908 | Althouse | 101/193 |
| 1,908,921 | 5/1933 | Rosenthal | 101/193 X |
| 3,812,779 | 5/1974 | Cobb | 101/193 X |

*Primary Examiner*—J. Reed Fisher

*Attorney, Agent, or Firm*—Silverman, Cass & Singer, Ltd.

[57] ABSTRACT

An alignment apparatus is provided for a serigraphic printing machine to align the objects to be printed on with the printing panels assuring alignment of the different colors applied at the several printing stations. The objects to be printed on are carried by supports which have a centering plate thereon and are pivoted around a pin opposite the centering plate. Each printing station is provided with a centering pin in registration with the printing panel at each station. Each centering pin is engaged into a slot of the centering plate to align the support and the object with the printing panel when printing is to occur. All of the centering pins are fixed along a rotatable rod adjacent the printing stations which is rotated by a hydraulic piston to engage the centering pins into their respective centering plate slots.

6 Claims, 3 Drawing Figures

SERIGRAPHIC PRINTING MACHINE PRINTING A NUMBER OF OBJECTS IN SEVERAL COLORS

BACKGROUND OF THE INVENTION

This invention relates to serigraphic printing machines for printing objects such as knitted goods with a different color at each of several different stations, and in particular, relates to alignment structure for each of the several printing stations so that the different colors are printed in proper registration.

A serigraphic printing machine allows continuous loading of the goods to be printed on, printing on the goods with each of the different desired colors and unloading of the goods from the machine after they have been printed on. Loading and unloading of the goods occurs at one long portion of the machine while printing of the different colors, one color at each different station, occurs along another parallel portion of the machine. The two portions of the machine are coupled together by circular terminal connectors. Each piece of goods is loaded on a separate support which is coupled to an endless chain, the endless chain moving the support through the loading, printing and unloading portions of the machine. The endless chain is moved step-by-step by an electric motor or other suitable means with the supports being stopped at each of the printing stations.

The problem with such a machine is that at each station the supports are not properly aligned with panels applying the colors. Consequently, the colors printed on the goods are superimposed on other colors which of course leads to a poor quality of printing and many rejects in the finished products.

In accordance with the invention, an alignment or centering plate having a centering slot is provided on each support and an alignment or centering pin is provided at each printing station to properly align the supports with the printing panels for proper registration of the color printed at each station.

SUMMARY OF THE INVENTION

A centering plate having a centering slot is provided on each support which may carry an object to be printed on, and each support is pivoted around a pin opposite the centering plate. Centering pins are adjustably fixed on a rotatable shaft extending along the printing stations with one pin in registration with the printing panel of each printing station. When printing is to occur, an arm rotates the shaft moving all the centering pins into engagement in their respective centering slots and aligning the objects to be printed on with their respective printing panels for proper registration of the colors to be printed.

Each printing station should have a centering pin engaging a slot in a centering plate of each support. It is not necessary that each pin have its own actuator, but it is sufficient that the pins are rigidly mounted on a rod that engages all the pins in their centering slots.

DESCRIPTION OF THE PREFERRED EMBODIMENT

As indicated above, the invention is concerned with providing alignment structure for each of the printing stations of a serigraphic printing machines, at which stations a different color is printed on objects, for example knitted goods.

Figure 1:
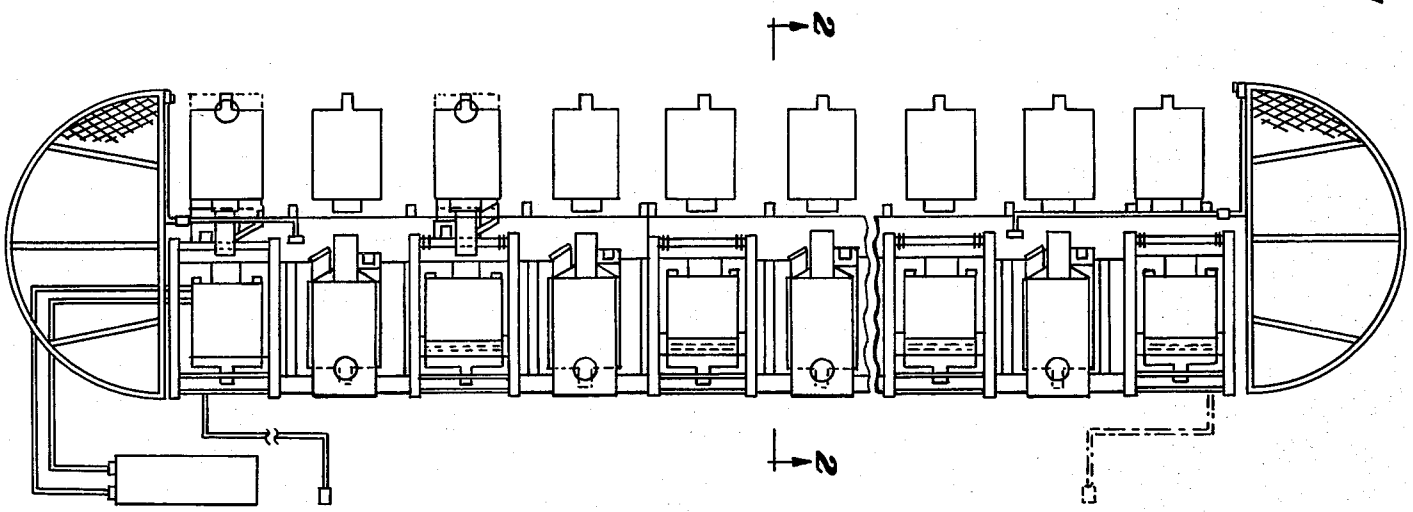
FIG. 1 is a plan view of a serigraphic printing machine.

As shown in FIG. 1, such a machine is generally elongate with one side A being provided for loading and unloading of the goods on and off of supports while the other side B is provided with the different printing stations. Goods are loaded on the machine at one end of portion A, are carried on supports coupled to an endless chain through each of the printing stations of portion B, and are carried back again to the other end of portion A where the printed goods are removed.

Figure 2:
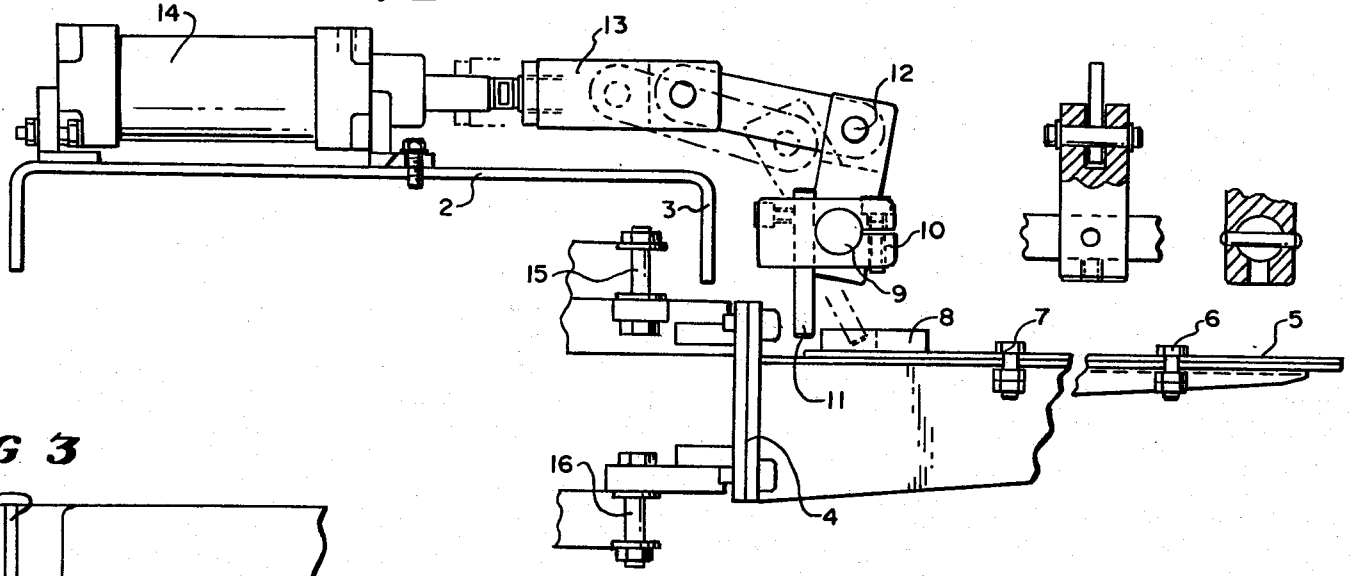
FIG. 2 is a sectional view of the serigraphic printing machine of FIG. 1 taken generally along the lines 2—2 and showing the alignment structure of the invention at one printing station.
Figure 3:
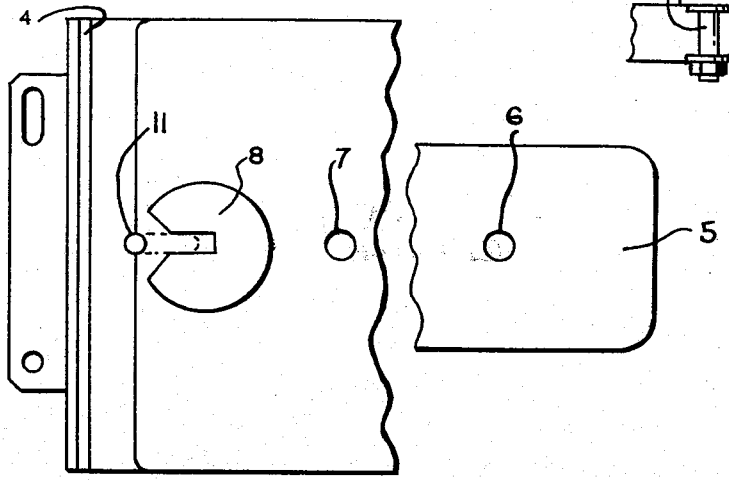
FIG. 3 is a part plan view of a support of the serigraphic printing machine showing an alignment plate and pivot pin of the invention.

As shown in FIG. 2, the serigraphic printing machine has a plate 2 of ovoid or egg shaped form extending the length of the machine and having downwardly depending lips 3. Brackets 4 extend outwards of and slide along lips 3 and are connected to an endless chain at two levels. The endless chain is located in the interior of the plate 2 and is driven in level motion by an electric motor not shown in the drawings.

Supports 5 are rotatably coupled to bracket 4 around a pin 6 passing through both brackets 4 and support 5. The rotational movement of support 5 is limited by a pin 7 attached to the support 5 and passing through a hole in bracket 4, said hole having a larger diameter than pin 7. The support 5 carries an adjustment or centering plate 8 having a straight centering slot along the axis of the support defined by the pins 6 and 7, and opening toward the base plate 2 of the machine. Extending the length of the machine is a rod 9, rotatable around its own axis to which are attached clamps 10 which are spaced from each other and which are adjustable along the length of the rod 9. Each clamp 10 carries a centering pin 11, which while the endless chain is moving the supports from station to station, has the position indicated in solid lines relative to the centering plate 8. The rod 9 is connected to a crank 12 through a yoke with the crank 12 being connected to a terminal yoke 13 of an actuating means such as a hydraulic piston 14.

When the endless chain moves the supports 5 into the printing positions, the hydraulic cylinder 14 moves the terminal rod 13 to the left as shown in FIG. 2, which rotates rod 9 counterclockwise, moving centering pin 11 into the centering slot of the centering plate 8 shown in dashed lines. This rotates support 5 around pin 6, registering support 5 with the respective printing panel and providing proper registration of the printed color on the goods carried by support 5.

When the printing cycle is completed, the hydraulic piston 14 returns the pin 11 to the original position and allows the chain to step the supports carrying the piece goods to the next printing station.

Thus, each printing station is provided with a pin 11 that enters a corresponding slot of a centering plate 8 of each support 5. All of the centering pins are controlled by a single hydraulic piston 14, eliminating a need for individual actuating means at each printing station.

Modifications and variations of the present invention are possible in light of the above teachings. It is, therefore, to be understood that within the scope of the apended claims the invention may be practiced otherwise than as specifically described.

What is claimed and desired to be secured by Letters Patent of the United States:

1. A serigraphic printing machine for printing several colors on objects, each object being carried on a bracket and each bracket being moved through several printing stations spaced from each other along a generally straight length of the machine, at each station a color being printed by a planar panel on each object in registration with the colors printed at the other stations, the machine comprising:

means for alignment of the object with the printing panel at each printing station to assure proper registration of the colors printed at the several stations, said means comprising:

a generally planar support connected to each bracket by a pivot pin around which the support is rotatable in its plane, the support arranged to be generally parallel with the planar panel when the panel is printing on the object and each support bearing the object on the bracket;

a centering plate fixed on each support and having a slot extending thereinto in alignment with an axis of the support passing through the pivot pin;

a rod extending and generally parallel to the straight length of the machine adjacent the printing stations and being rotatable around its longitudinal axis;

a centering pin at each printing station registerably fixed along the length of said rod, in a first rotational position of said rod said pins being engaged in said slots of said centering plates to align said supports with said centering pins and said objects with said panels, and in a second rotational position of said rod said pins being disengaged from said slots to allow said brackets to be moved through said printing stations; and actuating means for rotating said rod to said first and second rotational positions.

2. The machine as claimed in claim 1 in which there is a stop pin attached to the support between the pivot pin and the centering plate and extending into a hole in the bracket, the hole being larger in diameter than the stop pin with the rotation of the support around the pivot pin being limited by the travel of the stop pin in the hole.

3. The machine as claimed in claim 2 in which the support has a major axis along which the two pins are located and along which the slot of the centering plate is aligned.

4. The machine as claimed in claim 1 in which there is a framing plate extending the length of the machine and in which said centering pins are located between said framing plate and said centering plates and said slots open towards said framing plate.

5. The machine as claimed in claim 1 in which there are brackets registerably fixed on said rod and carrying said centering pins.

6. The machine as claimed in claim 1 in which said actuating means include a hydraulic piston having a piston rod coupled to said rod by a crank.

* * * * *